United States Patent [19]

Bakay

[11] 4,087,094

[45] May 2, 1978

[54] TRAFFIC BOARD GAME

[76] Inventor: Larry Bakay, 4 Ricker Rd., Kinnelon, N.J. 07405

[21] Appl. No.: 772,638

[22] Filed: Feb. 28, 1977

[51] Int. Cl.[2] ..... A63F 3/04

[52] U.S. Cl. ..... 273/254

[58] Field of Search ..... 273/134 C, 134 D, 134 AF, 273/134 AD, 134 AT, 134 BD, 134 GP, 134 ER, 134 E, 134 B, 134 G, 134 AC, 134 CA

[56] References Cited

U.S. PATENT DOCUMENTS

| | | | |
|---|---|---|---|
| 1,455,045 | 5/1923 | Conde | 273/134 C |
| 2,239,779 | 4/1941 | Clark et al. | 273/134 C |
| 3,924,858 | 12/1975 | Dittrich et al. | 273/134 D |
| 3,990,707 | 11/1976 | Terilli | 273/134 D |

FOREIGN PATENT DOCUMENTS

| | | | |
|---|---|---|---|
| 281,388 | 2/1966 | Australia | 273/134 AD |
| 1,238,838 | 7/1960 | France | 273/134 BD |
| 525,521 | 8/1940 | United Kingdom | 273/134 AT |
| 639,443 | 6/1950 | United Kingdom | 273/134 AT |
| 709,543 | 5/1954 | United Kingdom | 273/134 C |

*Primary Examiner*—Richard C. Pinkham
*Assistant Examiner*—Harry G. Strappello

[57] ABSTRACT

Game apparatus is disclosed comprising a game board having a plurality of intersecting one way and two way simulated roads. The two way roads have no passing zones thereon and in combination with the one way roads, lead to various destinations from points that may be used either as starting points or concluding points on the board. Destination cards and hazard cards are randomly selected during the course of game play for selecting destinations along the roads and hazards which hinder the advancement of a game piece. The roads are divided into spaces and movement of game pieces is advanced along the spaces by means of chance apparatus. Some of the spaces on the roads are longer than others to create an illusion of speed in the movement of game pieces.

8 Claims, 2 Drawing Figures

TRAFFIC BOARD GAME

SUMMARY OF THE INVENTION

The present invention relates to a game board having a plurality of intersecting simulated two way roads, lanes being provided within said two way roads running in opposite directions. A plurality of simulated one way roads intersect one another and the two way roads. The one way roads connect with and intersect the two way roads. The one way and two way roads have spaces along the length thereof for the advancement of game pieces over the spaces. Some of the spaces are of a greater length than the remainder of the spaces so that when a game marker is moved from space to space, an illusion of relatively greater speed is created when said spaces of a greater length are traversed.

Base points are marked on the board from which the game play may be initiated or concluded by game pieces. Destination points marked on the board are also provided to which game pieces may be moved during the course of game play. Game pieces are provided for movement along the spaces. Game piece chance members are provided for randomly selecting a number of spaces through which a game piece may be moved. Destination chance members are also provided for selecting the destination points to which the game pieces may be moved.

The destination chance members may comprise a plurality of chance cards, each of which bears indicia identifying one of the destinations. Some of the spaces on the game board have destination indicia requiring a player having a game piece touching thereon to select one of the chance cards.

The two way roads have no passing zones for preventing game pieces in the no passing zones from passing one another during the course of game play.

Hazard chance members are provided for selecting hazards that hinder the advance of game pieces during game play.

The hazard chance members may comprise hazard chance cards comprising a plurality of chance cards each of which bears indicia identifying one of such hazards, some of the spaces on the game board having hazard indicia requiring a player having a game piece touching thereon to select one of the hazard chance cards.

A stop sign member is provided on some of the spaces for stopping the advance of game play. The stop sign member may comprise stopping indicia on some of the spaces for stopping the advance of a game piece during game play by requiring a player having a game piece touching on one of said spaces having stopping indicia to stop the advancement of play until the stop chance member is operated to give indication that game play as to such piece may proceed.

The stop chance means in one embodiment comprises a spinner mounted on a plane, areas subtending the path of said spinner having indicia thereon indicating that a game piece may be advanced in play or held up in play.

It is an object of the present invention to provide a novel board type travel game.

It is further object of the present invention to provide a novel board type travel game in which various simulated roads are positioned on a game board, some of the roads being arranged to give an illusion of relatively greater speed of movement of a game piece over such roads during the course of game play.

It is a further object of the present invention to provide a game board in which the roads are arranged to create traffic jams and in which a player has to use ingenuity and skill to maneuver in and out of potential areas of traffic jams to arrive at destinations that are randomly selected.

These and other objects of the present invention have been achieved and will become apparent by reference to the disclosure and claims that follow as well as the appended drawing.

Figure 1:
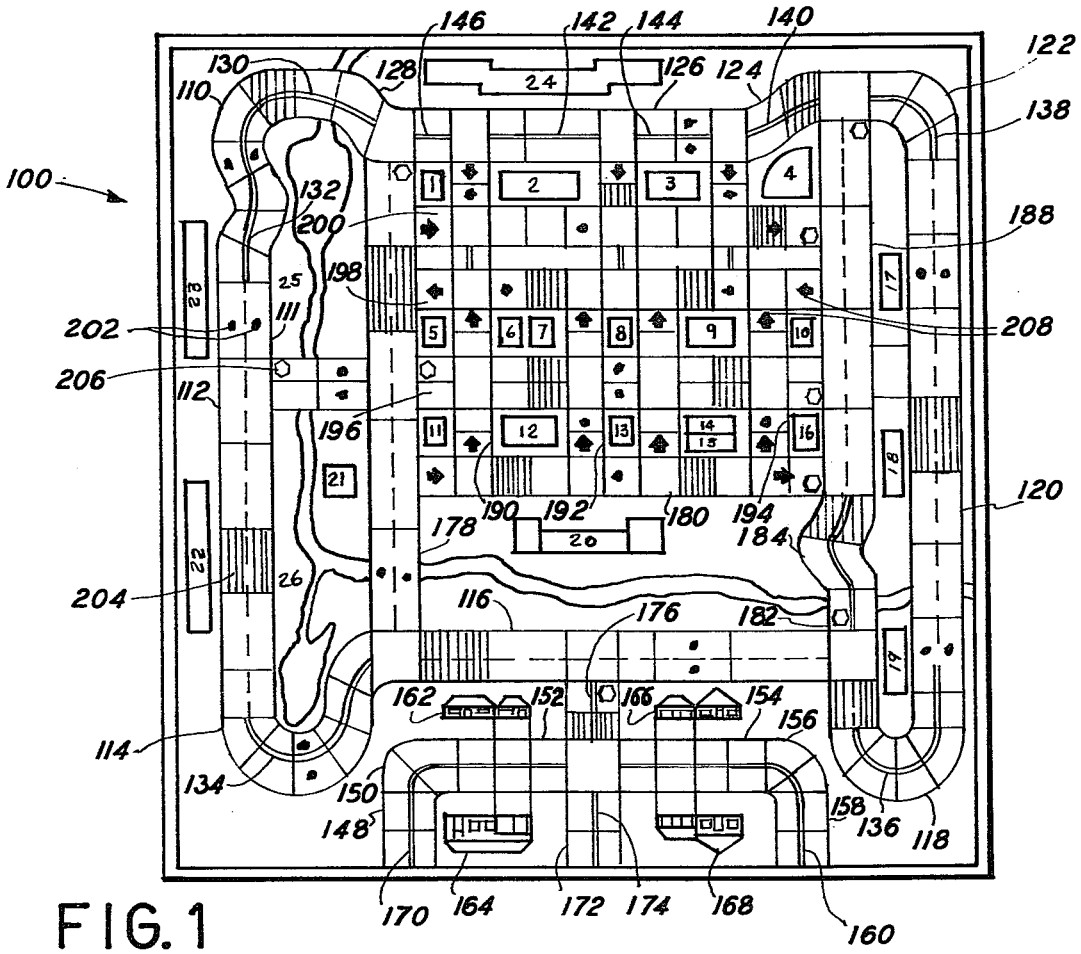
FIG. 1 comprises a plan view of a game board having various two way and one way roads marked theron along with destinations, starting points and indicia for selecting destination cards, hazard cards, stopping spaces according to one embodiment of the present invention.
Figure 2:
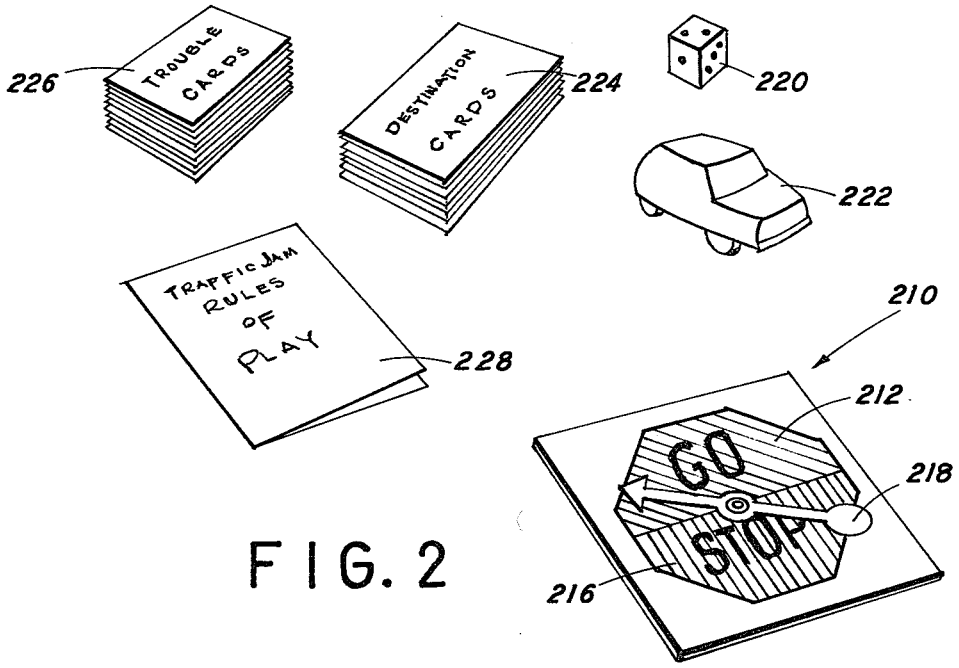
FIG. 2 comprises a perspective view of various game components including a game marker, a dial, a spinner, hazard cards or trouble cards, destination cards and rules of play according to another embodiment of the present invention. Board type travel games are disclosed in the prior art U.S. Patents Spohn No. 3,883,142; Smith No. 3,851,881; Alelyunas No. 2,977,417; Gilmour No. 2,757,933; McLeod No. 2,470,632; Clark, et al., No. 2,239,779; Potter No. 1,527,219 and Conde No. 1,455,045.

Referring to the drawing and FIGS. 1 and 2, a novel game board apparatus having a game board 100 is illustrated in which various destinations along simulated roads are indicated by the following numbers:

1. Doctor's Office
2. Movie Theatre
3. Post Office
4. Baseball Stadium
5. Car Wash
6. Dentist's Office
7. Beauty Shop
8. Drugstore
9. Restaurant
10. Soft Ice Cream Store
11. Clothing Store
12. Jail
13. Repair Shop
14. 5 & 10 Store
15. Hardware Store
16. Sporting Goods Store
17. Toy Store
18. Bowling Alley
19. Inspection Station
20. High School
21. Gas Station
22. Department Store
23. Supermarket
24. Hospital
25. North Park
26. South Park The game board has a simulated two way road with lanes going in opposite directions and having a cure section 110 leading into the straight-away 111 and 112, a curved section 114, a straight-away section 116, a curved section 118, a straight-away section 120, a curved section 122, another curved section 124, a straight-away section 126 and a curved section 128. No passing zones are indicated by the double lines 130, 132, 134, 136, 138, 140, 142, 144 and 146. Another two-way road divided into two lanes going in opposite directions is provided, a section 148 leading into a curved portion 150, a straight-away 152, a second straight-away 154, a curved portion 156 and a straight-away 158. No passing double lines 160 and 170 are also provided. Starting and/or destination points 162, 164, 166 and 168 are positioned along this road. Another two way road having a straight-away section 172 intersects the straight-away portions 154 and 152. No passing lines 174 and 176 are provided on this road.

Another two way road being broken down into two lanes is also provided comprising road section 178 which intersects straight-away 116 and straight-away 126.

Another two way road having lanes going in opposite directions is provided comprising road section 188 having a curved section 184 thereon and a straight-away section 182, this road intersecting with two way roads 116 and the curved portions of a two way road 122 and 124. One way road 180 is provided, the direction of travel on this road being indicated by the arrows thereon, one way road 180 intersecting with sections 178 and 188 of the two way roads previously described. A two way road 196 broken down into two lanes, each lane going in opposite directions, is also provided, two way road 196 intersecting two way road sections 178 and 188.

A one way road section 198 the direction of travel over which is indicated by arrows is also provided, one way road section 198 intersecting road sections 178 and 188 as does one way road 200, the direction of travel over road 200 also being indicated by the arrows marked thereon. These various arrows employed throughout the game board are exemplified by the arrows 208. Cross roads which are also one way roads are provided comprising roads 190, 192, 180 and 194, all of which intersect at one way road 180. The direction of travel on these roads is also indicated by the arrows on the various spaces. Various aligned sections such as are illustrated by section 204 in straight-away 112 of the two way road previously described are provided througout all of the roads, these sections when landed on by a game piece allowing the game player to select one of the destination cards. Hexagonal markings such as a marking 206 on straight-away 196 are alos positioned in the various sections that the roads are divided into so that when a game piece touches on such a section, the piece must come to a stop and advancement is prohibited until the spinner 210 is operated so that the needle points to the area subtending the spinner 212 which indicates that a game piece may be advanced.

A plurality of game pieces such as the simulated automotive vehicle 222 may be employed by any number of players from two upwards, the greater number of players, the greater the likelihood of a traffic jam which is one of the degrees of difficulty that enters into the play of the game. In one embodiment, four players may compete in the game. A die 220 is provided along with destination cards 224 and hazard or trouble cards 226. Rules of play 228 may also be provided as part of the game apparatus.

In one embodiment, the game is played with four players who each start out from the starting points 162, 164, 166 and 168 which are located in an area of the board that may be designated a suburban area. Each player may be dealt a fixed number of destination cards and in one embodiment of the rules, each player is dealt three cards which indicate to the players the destination or the building they must proceed to. Each player then rolls the die 220 to determine by whom a game play is initiated such as by the rolling of the highest or the lowest number on the die after which the players proceed in sequence in a clockwise direction. Once the starting player is determined, the player throws the die and the game piece 222 which he is assigned is moved on each of the spaces, one move on each space being accorded each point obtained on the die. The various obstacles such as the hazards exemplified by the indicia 202, stop signs as indicated by the indicia 206 and one way streets as indicated by the arrows on the various one way roads noted before slow down the advancement of a game piece to any of the destinations. The passing and no-passing zones on the two way roads also prevent players from passing one another on turns and where otherwise indicated. All players must stay to the right and can only pass another player in the passing zone. When a player reaches a stop sign, i.e., one of the hexagonal marks on the board such as sign 206, they must stop and rotate the needle 218 on the chance member 210 until the needle points to the area 212. If the needle 218 points to the area 216, the layer must wait until his successive turn to operate the chance apparatus 210, another time in an attempt to have the needle stop in the area 212.

It will be noticed the layout of one way streets towards the center of the game board interferes with one player passing one another and increases the likelihood of players competing for the same space. This concentration of one-way roads in the center of the game board leads to the likelihood of traffic jams in this area from which one of the strategies of the game may be developed. For example, if a player believes that one of the competing players is going for any one of the destinations in the center area of the game board, he may interpose his playing piece in that area for a number of moves in order to hold the competing player to prevent them moving into such a centrally located destination.

Every time a player lands on one of the squares with the lines in it as exemplified by square 204, they must pick up an additional destination card which means that a player must proceed to another destination besides the three they were dealt in the beginning of the game. There is no limit to the number of destination cards a player has to pick up and every time a player gets to the destination, they place that card on the bottom of the pile. This assures that there will always be a continuous supply of destination cards.

The dots as exemplified as the dots 202 represent potholes in the roads and every time player lands on one of these, they pick a card from the deck 226. These cards have any one of a plurality of instructions that interfere with the progress of game play for that player such as an auto breakdown, a police ticket or violation and the like. It should also be emphasized that there is one destination card for each one of the destinations previously identified herein.

Additionally, every player may act in the capacity of a policeman which allows them whenever a competing player commits a traffic violation to call out the violation and send the violator to jail. Once the player is in jail, they have to roll an even number on the die to get out with a maximum of three rolls.

The markers 222 may be of different colors and/or designs and in one embodiment are made out of a plastic material. Various pictures may be provided at each destination 1–26 on the board. Stop signs such as those exemplified by the hexagon 206 may be imprinted on the board or may be made of molded plastic and stand erect as a three-dimensional sign. In the latter embodiment, the stop signs may be placed on the board at any point desired by the players or in accord with a plan which is imprinted on the board.

Although the invention has been described by reference to some embodiments it is not intended that the novel game be limited thereby but that modifications thereof are intended to be included as falling within the broad spirit and scope of the foregoing disclosure, the following claims and the appended drawing.

What is claimed is:

1. A game apparatus comprising a board having a plurality of intersecting simulated two way roads, lanes within said two way roads running in opposite directions, a plurality of simulated one way roads intersecting one another and said two way roads, said one way roads connecting with and intersecting said two way roads, said one way and two way roads having spaces along the length thereof for the advancement of game pieces over said spaces, some of said spaces being of a greater length than the remainder of said spaces so that when a game marker is moved from space to space, an illusion of relatively greater speed is created when said spaces of a greater length are traversed, base points marked on said board from which game play may be initiated or concluded by game pieces, destination points marked on said board to which game pieces may be moved during the course of game play, game pieces for movement along said spaces, game piece chance means for randomly selecting the number of said spaces through which a game piece may be moved, destination chance means for selecting destination points to which said game pieces may be moved.

2. The game apparatus of claim 1 where said destination chance means comprise a plurality of chance cards each of which bears indicia identifying one of said destinations, some of said spaces on said game board having destination indicia requiring a player having a game piece touching thereon to select one of said chance cards.

3. The game apparatus of claim 1 where said two way roads have no passing zones for preventing game pieces in said no passing zones from passing one another during the course of game play.

4. The game apparatus of claim 1 further comprising hazard chance means for selecting a hazard which hinders the advancement of a game piece during game play.

5. The game apparatus of claim 4 where said hazard chance means comprises a plurality of hazard chance cards each of which bears indicia identifying one of said hazards, some of said spaces on said game board having hazard indicia thereon requiring a player having a game piece touching thereon to select one of said hazard cards.

6. The game apparatus of claim 1 further comprising stopping means on said board for stopping the advance of game play.

7. The game apparatus of claim 6 where said stopping means comprises stop chance means and stopping indicia on some of said spaces for stopping the advance of a game piece during game play by requiring a player having a game piece touching on said stop sign space to stop the advancement of play until stop chance means are operated to give an indication that game play as to such piece may proceed.

8. The game apparatus of claim 7 where said stop chance means comprises a spinner mounted on a plane surface having areas subtending the path of said spinner indicating that a game piece may be advanced or that a game piece may not be advanced.

* * * * *